US006624840B1

(12) United States Patent
Kawamura et al.

(10) Patent No.: US 6,624,840 B1
(45) Date of Patent: Sep. 23, 2003

(54) AUTOMATIC EXPOSURE APPARATUS FOR PRINTING PLATES AND METHOD FOR EXPOSING PRINTING PLATES

(75) Inventors: Yoshinori Kawamura, Kanagawa (JP); Yoshihiro Koyanagi, Kanagawa (JP); Mitsuyoshi Nishimura, Saitama (JP); Takashi Kato, Saitama (JP)

(73) Assignees: Fuji Photo Film Co., Ltd., Kanagawa (JP); Fuji Photo Optical Co., Ltd., Saitama (JP)

( * ) Notice: Subject to any disclaimer, the term of this patent is extended or adjusted under 35 U.S.C. 154(b) by 0 days.

(21) Appl. No.: 09/664,064

(22) Filed: Sep. 18, 2000

(30) Foreign Application Priority Data

Sep. 17, 1999 (JP) ..... 11-264188

(51) Int. Cl.[7] ..... B41J 2/435
(52) U.S. Cl. ..... 347/264; 347/262
(58) Field of Search ..... 347/262, 264, 347/134, 138; 355/73; 101/389.1; 248/362, 363; 269/21; 417/307, 309

(56) References Cited

U.S. PATENT DOCUMENTS 2,723,775 A * 11/1955 Von Hofe et al. ..... 269/21
3,759,613 A * 9/1973 Denis ..... 355/73

FOREIGN PATENT DOCUMENTS

JP 10-268524 A * 10/1998 ..... G03F/7/20

* cited by examiner

*Primary Examiner*—Hai Pham
(74) *Attorney, Agent, or Firm*—Sughrue Mion, PLLC

(57) ABSTRACT

An automatic exposure apparatus for printing plates and a method for exposing printing plates, which can prevent a defective image such as an unfocused image from being formed when an image is recorded onto the printing plate is provided. Suction holes are formed at a surface plate 110 of an automatic exposure apparatus 100 for printing plates, and a vacuum pump 306 communicates with the suction holes. A solenoid valve 308 is provided at a communicating path 304 between the suction holes and the vacuum pump 306, and a chamber 310 is provided at the communicating path 304 between the solenoid valve 308 and the vacuum pump 306. The solenoid valve 308 is closed and the vacuum pump 306 is operated in a state in which a photopolymer plate 102 is disposed on a top surface of the surface plate 110, and the solenoid valve 308 is opened completely in an instant in a state in which a pressure of a decompressed interior of the chamber 310 is a predetermined value or lower, such that the decompressed interior can suck air all at once from the suction holes with a strong suction force. Accordingly, a curled photopolymer plate 102 can be brought in complete contact with the top surface of the surface plate 110, and thus, a defective image such as an unfocused image is prevented when an image is recorded.

15 Claims, 14 Drawing Sheets

AUTOMATIC EXPOSURE APPARATUS FOR PRINTING PLATES AND METHOD FOR EXPOSING PRINTING PLATES

BACKGROUND OF THE INVENTION

1. Field of the Invention

The present invention relates to an automatic exposure apparatus for printing plates and a method for exposing printing plates, in which a printing plate is disposed at a predetermined position on a top surface of a surface plate so as to record an image on the printing plate.

2. Description of the Related Art

In a conventional automatic exposure apparatus for printing plates, for example, printing plates in which photosensitive layers (e.g., photopolymer layers) are provided on supports are used, and the printing plates are accommodated in an accommodating cassette. Further, a table is provided in the interior of the automatic exposure apparatus for printing plates, and the printing plate conveyed from the accommodating cassette is disposed at a predetermined position on a top surface of the table. A plurality of through-holes and a plurality of sucking grooves communicating with the through-holes are formed on the top surface of the table. When air is sucked from the through-holes by a vacuum pump, the interior of the through-holes and the sucking grooves is brought to a vacuum state. As a result, the printing plate disposed on the top surface of the table is in a state of being vacuum-sucked onto the top surface of the table. In this state, an image is directly recorded on the photosensitive layer of the printing plate by laser beams or the like.

However, in such automatic exposure apparatus for printing plates, when the printing plate is singly stored, the printing plate may curl naturally. If this curled printing plate is disposed on the top surface of the table, the printing plate is raised up further from off the top surface of the table towards the outer peripheral portion of the printing plate. Accordingly, even when an attempt is made to suck this curled printing plate onto the top surface of the table, sometimes the printing plate cannot be sucked so as to be in complete contact with the top surface of the table with only the normal sucking ability of the vacuum pump (i.e., the printing plate partially comes up from off the top surface of the table). As a result, such a problem may be caused that a defective image such as an unfocused image is formed when an image is recorded onto the printing plate. This problem is particularly remarkable when the support is made of aluminum so as to form a hard printing plate (so-called photopolymer plate).

As a related art of the present invention, a device for sucking sensitive materials is disclosed in Japanese Patent Application Laid-Open (JP-A) No. 10-268524. This device consists of a table in which many suction holes and grooves are formed, essentially three air hoses which communicate with the suction holes, three solenoid valves each of which is provided at each of the air hoses, and a vacuum pump. Initially, one of the solenoid valves is opened, and a sensitive material is sucked with a predetermined suction force by the many suction holes communicating with the vacuum pump. Then, the other two solenoid valves are opened, and the same sensitive material is sucked with a suction force which is weaker than the former predetermined suction force. However, in this device, the suction force for the sensitive material depends solely upon sucking ability of the vacuum pump, and there is no structure for increasing the suction force by an element other than the vacuum pump.

Accordingly, the sensitive material is not sufficiently sucked, and this may result in a drawback such as a defective image being formed.

SUMMARY OF THE INVENTION

In consideration of the above facts, it is an object of the present invention to obtain an automatic exposure apparatus for printing plates and a method for exposing printing plates, which can prevent a defective image such as an unfocused image from being formed when an image is recorded onto the printing plate.

In accordance with a first aspect of the present invention, a sucking-holding device for sucking and holding a flexible thin plate onto a top surface of a base comprises: a suction path, which has a plurality of apertures on the top surface of the base; a suction unit, which is for sucking air from the apertures via the suction path; a suction line, which communicates with the suction path and the suction unit; a valve device, which is provided on the suction line, and which can open and close the suction line; a hollow body, which is provided on the suction line between the valve device and the suction unit, and which has a predetermined internal capacity whose pressure can be decreased by an operation of the suction unit; and a controller, which can open the valve device, when the internal pressure of the hollow body has reached a predetermined value or lower, or in accordance with a duration of operation of the suction unit. In this case, when the suction line is opened by an operation of the valve device, the hollow body whose internal pressure has been decreased and the suction path (thus, the apertures) communicate with each other, and the flexible thin plate is sucked and held onto the top surface of the base. At this time, a strong suction force is temporarily applied to the flexible thin plate via the apertures, because of the existence of the hollow body whose internal pressure has been decreased in the suction line. As a result, the flexible thin plate can be reliably fixed instantaneously on the top surface of the base.

In accordance with a second aspect of the present invention, a sucking method, in a sucking device for sucking a flexible thin plate onto a top surface of a base, the device comprising: a suction path, which has a plurality of apertures on the top surface of the base; a suction unit, which is for sucking air from the apertures via the suction path; a suction line, which communicates with the suction path and the suction unit; a valve device, which is provided on the suction line, and which can open and close the suction line; and a hollow body, which is provided on the suction line between the valve device and the suction unit, and which has a predetermined internal capacity whose pressure can be decreased by an operation of the suction unit; comprises steps of: (a) operating the suction unit so as to decrease the internal pressure of the hollow body; and (b) opening the suction line via the valve device. In this case, the internal pressure of the hollow body is considerably decreased by an operation of the suction unit. Then, the interior of the hollow body and the suction path communicate with each other by an operation of the valve device, and a strong suction force is generated instantaneously at the apertures. As a result, the flexible thin plate is sucked instantaneously, and fixed onto the top surface of the base.

In accordance with a third aspect of the present invention, an exposure apparatus, which includes a sucking device for sucking a printing plate onto a top surface of an exposing base, and which records an image onto the printing plate, comprises: a suction path, which has a plurality of apertures on the top surface of the exposing base; a suction unit, which is for sucking air from the apertures via the suction path; a suction line, which communicates with the suction path and the suction unit; a valve device, which is provided on the suction line, and which can open and close the suction line; a hollow body, which is provided on the suction line between the valve device and the suction unit, and which has a predetermined internal capacity whose pressure can be decreased by an operation of the suction unit; and a controller, which can open the valve device when the internal pressure of the hollow body has reached a predetermined value or lower. In this case, the printing plate, which is generally formed of a plurality of layers and curls easily, is sucked instantaneously due to a low pressure of the interior of the hollow body which has a large capacity. As a result, the printing plate can be in contact with and fixed onto the top surface of the exposing base. Therefore, the formation of defective images is decreased or eliminated in the exposure process which follows.

BRIEF DESCRIPTION OF THE DRAWINGS

FIG. 10 is a schematic structural view showing the surface plate, a solenoid valve, a chamber, a vacuum pump and the like.

DESCRIPTION OF THE PREFERRED EMBODIMENTS

Figure 1:
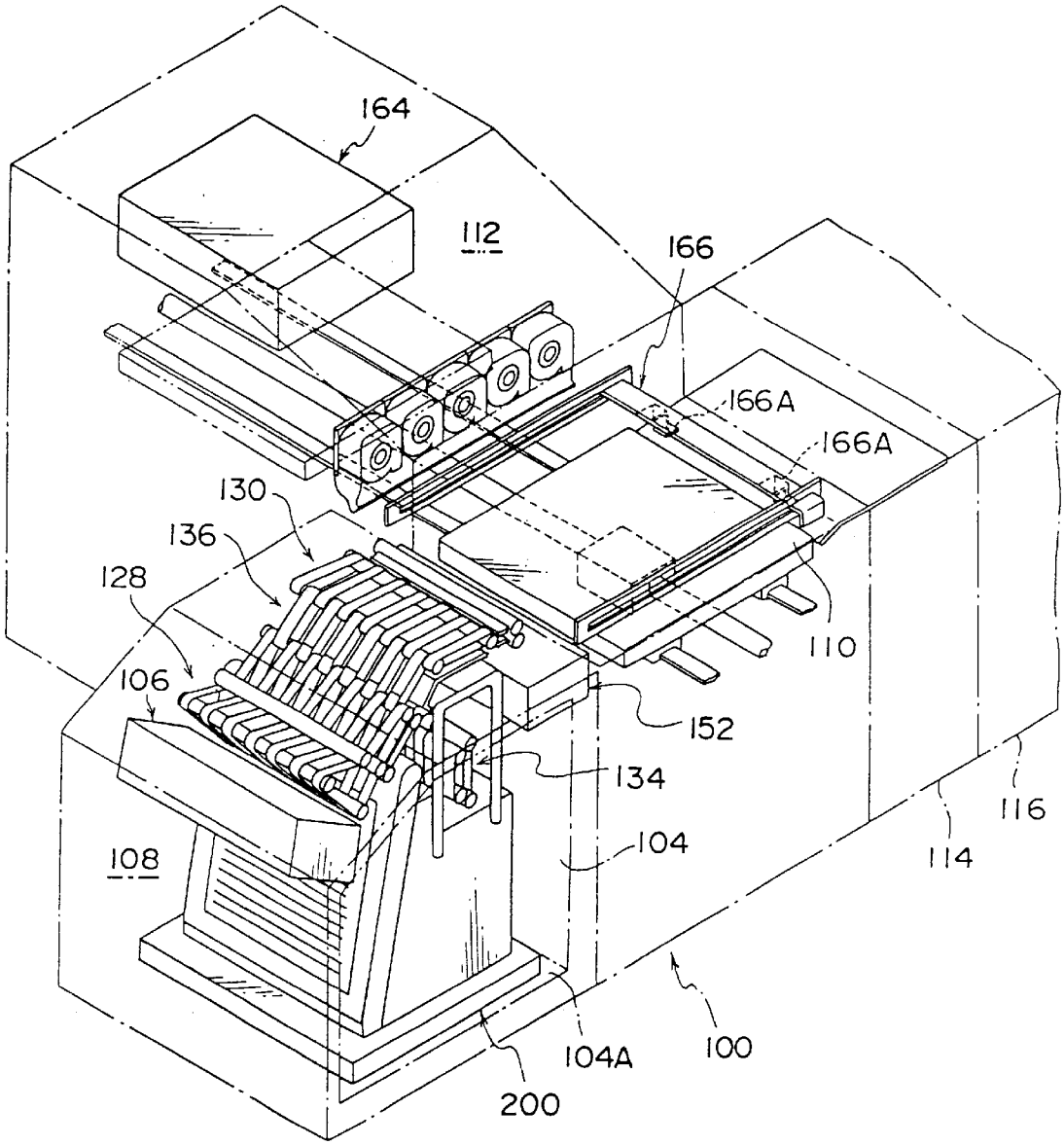
FIG. 1 is a perspective view showing an overall structure of an automatic exposure apparatus for printing plates according to the present embodiment.

An automatic exposure apparatus 100 for printing plates, according to the present embodiment, which apparatus is used for photopolymer plates (i.e., printing plates in which photosensitive layers (e.g., photopolymer layers) are provided on hard aluminum supports), is shown in FIG. 1.

The automatic exposure apparatus 100 for printing plates, consists of a plate supplying section 108, which includes a plate accommodating portion 104 that accommodates photopolymer plates 102 (see FIG. 2) loaded on a trolley 200, and includes a sheet feeding portion 106 that carries out the photopolymer plate 102 accommodated in the plate accommodating portion 104; a table-shaped surface plate 110 as an exposing table on which the photopolymer plate 102 is a positioned and held; and an exposure section 112 which records an image on the photopolymer plate 102 positioned on the surface plate 110.

An automatic developing apparatus 116 for printing plates, can be provided at a downstream side of the automatic exposure apparatus 100 for printing plates, via a buffer portion 114. Thus, all of the plate-supplying, exposing and developing processes can be automatically carried out.

Figure 2:
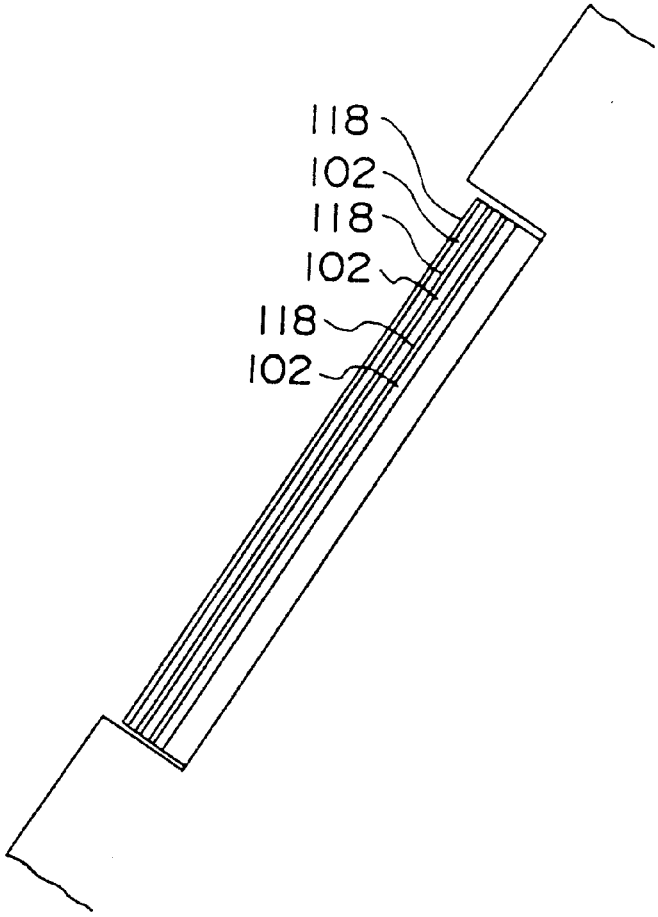
FIG. 2 is a side view showing a state in which photopolymer plates and interleaf sheets are loaded in a magazine.
Figure 3:
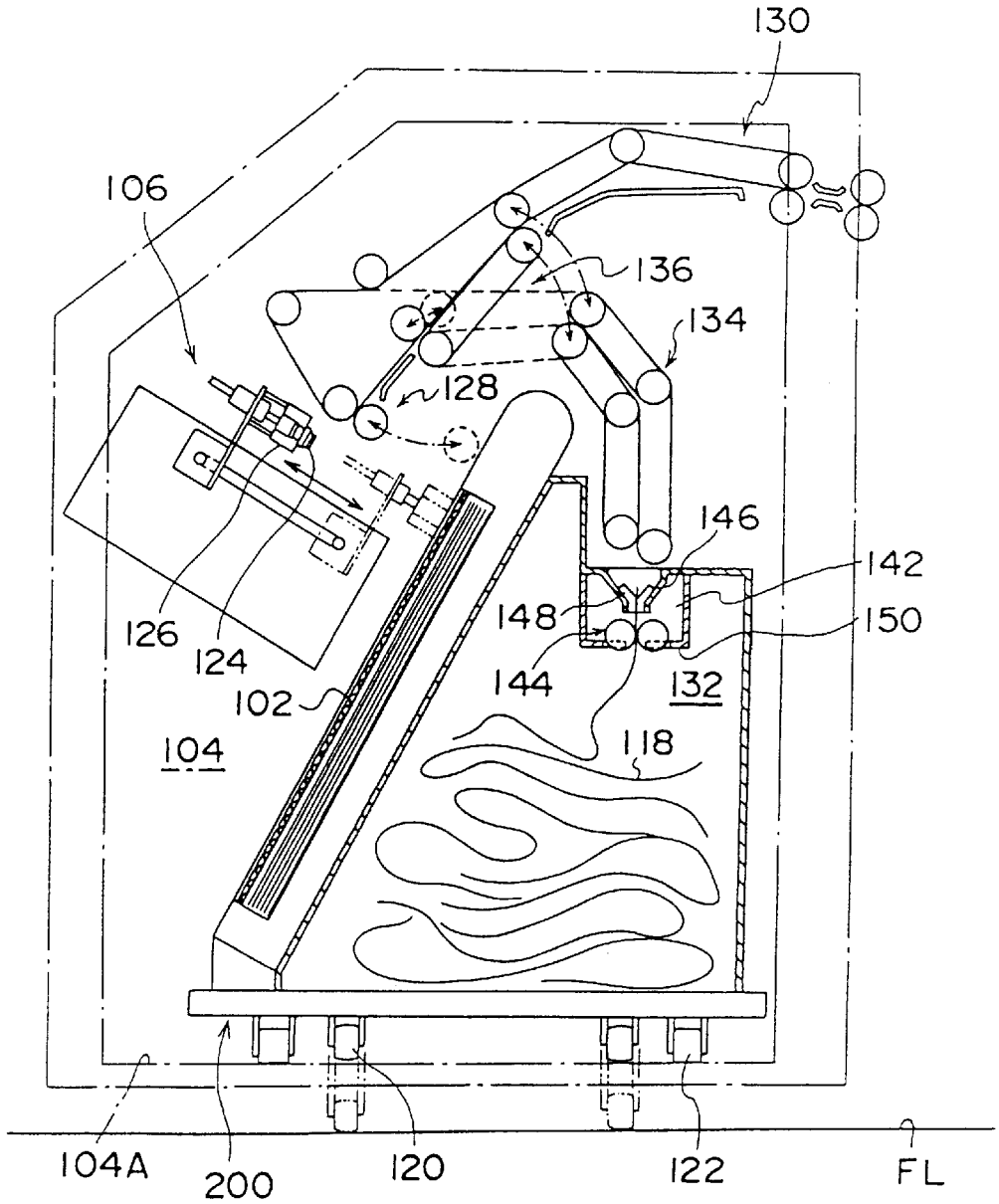
FIG. 3 is a side view of a plate supplying section.

As shown in FIG. 3, the plate accommodating portion 104 can accommodate the trolley 200 against which a plurality of photopolymer plates 102 are propped. As shown in FIG. 2, a protective interleaf sheet 118 is provided on a surface of each photopolymer plate 102, and as a result, the photopolymer plates 102 and the interleaf sheets 118 are alternately superimposed.

The plate accommodating portion 104 forms a floor portion 104A at a higher position than a ground surface, and the trolley 200 is structured so that it can be mounted onto the floor portion 104A from the ground surface. Specifically, the trolley 200 is supported to the ground surface via casters 120, and each of the casters 120 can move to protruding positions (i.e., the positions shown with notched lines in FIG. 3) or to stored positions (i.e., protruding positions in FIG. 3) with respect to the trolley 200.

At the same time when the casters 120 move to the stored positions so as to be upwardly collapsed toward the plate accommodating portion 104 due to a storing operation, auxiliary rollers 122 correspond to the floor portion 104A. Thereafter, the trolley 200 is supported to the floor portion 104A via the auxiliary rollers 122.

The sheet feeding portion 106 is provided above the plate accommodating portion 104. The sheet feeding portion 106 is structured so as to alternately pick up the photopolymer plate 102 and the interleaf sheet 118 from a state in which they are stacked, and send them to a common conveying portion 128. The sheet feeding portion 106 includes a sucker 124, which sucks the photopolymer plate 102 and the interleaf sheet 118. Further, a suction fan 126 is separately provided near the sucker 124, as an auxiliary means for sucking the interleaf sheet 118. The sucker 124 and the suction fan 126 can move integrally toward and away from a surface of an interleaf sheet 118 or of a photopolymer plate 102, which are stacked together.

When the photopolymer plate 102 is sucked and held, the sucker 124 is disposed so as to be in contact with the photopolymer plate 102. However, when the interleaf sheet 118 is sucked and held, the suction fan 126 is disposed such that the interleaf sheet 118 is slightly away from (or may be disposed in contact with) it, and only the suction fan 126 is operated. The suction fan 126 sucks up only the interleaf sheet 118 which is light-weighted and thin, and thereafter, the sucker 124 sucks the interleaf sheet 118. As a result, when the interleaf sheet 118 is sucked, double suction (i.e., suction of the interleaf sheet 118 together with the underlaid photopolymer plate 102) is prevented.

The plate supplying section 108 largely consists of the common conveying portion 128, which receives the photopolymer plate 102 or the interleaf sheet 118 from the sheet feeding portion 106 and conveys it; a photopolymer plate conveying portion 130, which forms a part of a conveying means for receiving the photopolymer plate 102 and sending a it to the surface plate 110; an interleaf sheet conveying portion 134, which receives the interleaf sheet 118 and sends it to an interleaf sheet accommodating box 132 (loaded on the trolley 200); and a conveyance switch portion 136, which guides the photopolymer plate 102 or the interleaf sheet 118 from the common conveying portion 128 to either the photopolymer plate conveying portion 130 or the interleaf sheet conveying portion 134 by a switching operation.

Specifically, as the photopolymer plates 102 and the interleaf sheets 118 are alternately stacked, each time the photopolymer plate 102 or the interleaf sheet 118 is sucked at the sheet feeding portion 106, the conveyance switch portion 136 switches and conveys the photopolymer plate 102 or the interleaf sheet 118 to the respective predetermined direction.

Figure 4A:
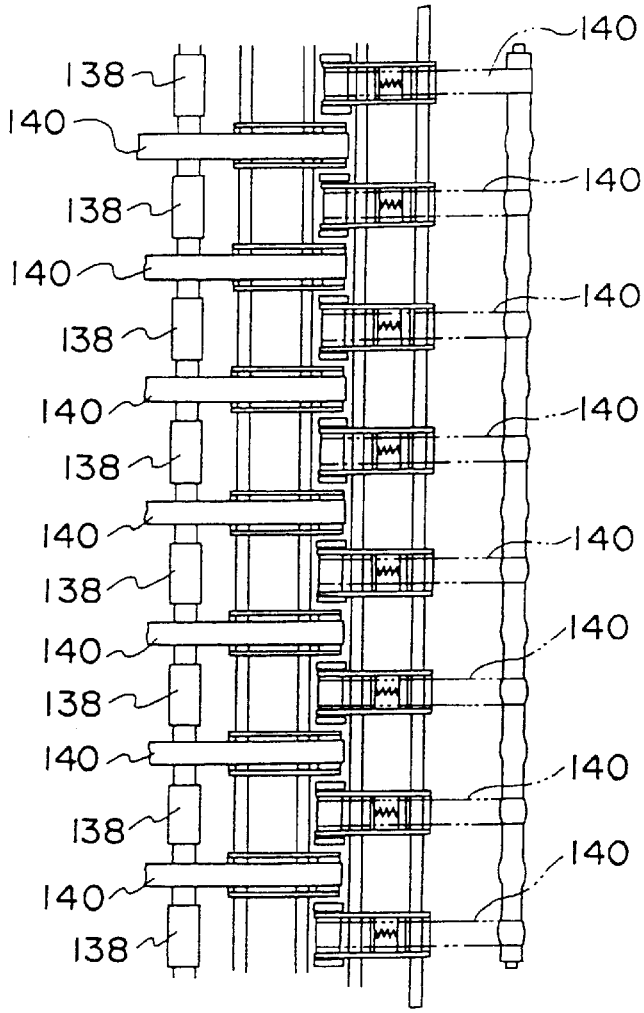
FIG. 4A is a plan view showing a portion of a conveying system of the plate supplying section.
Figure 4B:
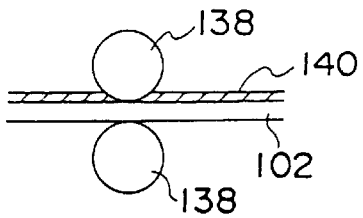
FIG. 4B is a side view showing a portion of the conveying system of the plate supplying section.

As shown in FIG. 4A, the common conveying portion 128, the photopolymer plate conveying portion 130 and the conveyance switch portion 136 are a conveying system in which skewered rollers 138 and narrow belts 140 are combined, and this conveying system is formed so as to mainly convey the photopolymer plate 102 (see FIG. 4B). Specifically, the photopolymer plate 102 is conveyed with a strong nipping force of the skewered rollers 138, and the narrow belts 140 serve as guide panels which move synchronously with the conveyance.

Figure 4C:
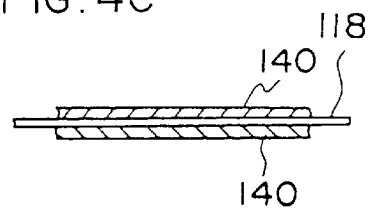
FIG. 4C is a side view of an essential portion of an interleaf sheet conveying portion.

On the other hand, as shown in FIG. 4C, the interleaf sheet conveying portion 134 is a conveying system including only the narrow belts 140. The interleaf sheet 118 is conveyed with a weak nipping force of the narrow belts 140.

Figure 5:
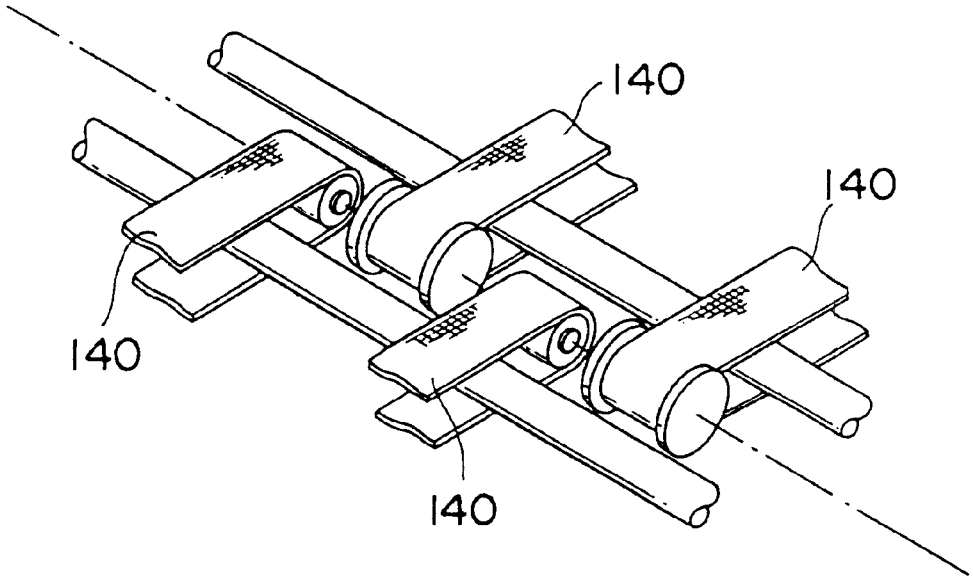
FIG. 5 is a perspective view showing a delivery portion for passing the printing plates between different conveying systems of the plate supplying section.

As shown in FIG. 5, at a portion for delivery from one conveying portion to another, end portions thereof alternately protrude in a skewered configuration, such that a recessed end portion of one corresponds to a protruded end portion of the other (i.e., both end portions have a coaxial common conveying path). As a result, when the photopolymer plate 102 and the interleaf sheet 118 are delivered, they are prevented from being caught in the skewered rollers 138 and the narrow belts 140.

As shown in FIG. 3, the interleaf sheet 118 conveyed by the interleaf sheet conveying portion 134 is guided to the interleaf sheet accommodating box 132 provided on the trolley 200. An insertion opening 142 for the interleaf sheets 118, which is provided at an upper portion of the interleaf sheet accommodating box 132, is provided with a pair of rollers 144, and the rollers 144 drive rotatively at a linear velocity, which is slightly higher (about 1.1 times) than the conveyance velocity of the interleaf sheet conveying portion 134. Accordingly, when the interleaf sheet 118 is between the interleaf sheet conveying portion 134 and the rollers 144, the interleaf sheet 118 is conveyed while maintaining a predetermined tense state. As a result, jamming resulting from slackness and the like is prevented.

Tapered guide panels 146, by which the width (in the thickness direction of the interleaf sheet 118) is gradually narrowed, are provided at an upstream side of the insertion opening 142. A charge removing brush 148 is attached to each of the tapered guide panels 146 which oppose each other, and the charge removing brushes 148 remove charge from the interleaf sheet 118 inserted into the insertion opening 142.

The pair of rollers 144 are arranged in a skewered configuration, and partition panels 150 are provided along the protruding portion which result from the skewered configuration. As a result, even if a part of the interleaf sheet 118, which has been inserted into the insertion opening 142, touches the rollers 144, the partition panels 150 prevent the interleaf sheet 118 from being caught in the rollers 144.

As shown in FIG. 1, the photopolymer plate 102 conveyed by the photopolymer plate conveying portion 130 leaves the photopolymer plate conveying portion 130 in a horizontal conveyance state, and is delivered to the surface plate 110.

Figure 6A:
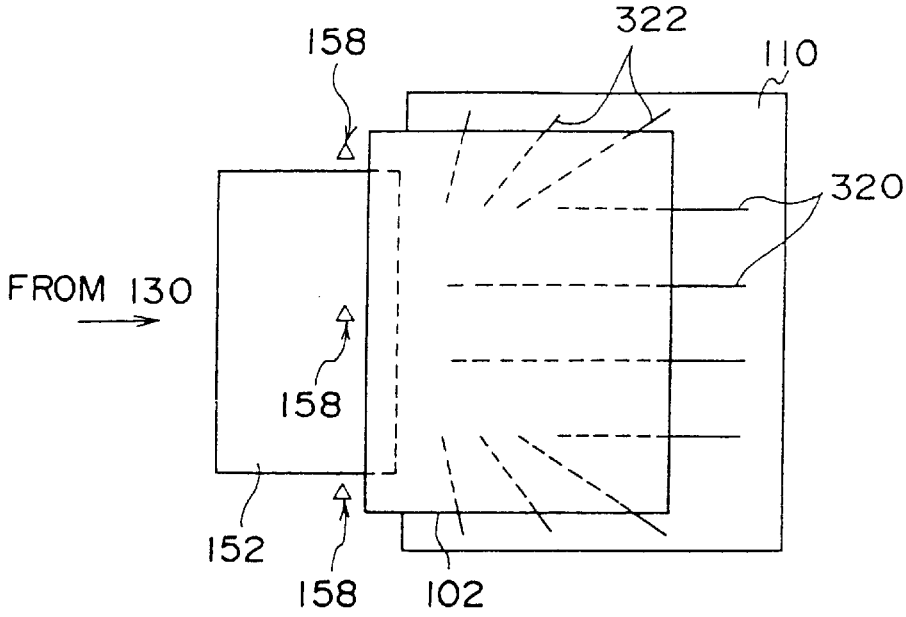
FIG. 6A is a plan view of a surface plate.

A height of a top surface as a loading surface of the surface plate 110 is lower than a horizontal conveyance height of the photopolymer plate conveying portion 130, and there is a slight gap therebetween in the conveying direction. Accordingly, when the photopolymer plate 102 is discharged from the photopolymer plate conveying portion 130, the photopolymer plate 102 lands on the surface plate 110 in a state in which it hangs slightly, and a rear end portion of the photopolymer plate 102 in the conveying direction is positioned at a more upstream position than the surface plate 110. A temporary support plate 154, which is provided on a moving body 152 that can move toward and away from the surface plate 110, is disposed at this upstream position (see FIGS. 6A and 6B), and the temporary support plate 154 prevents the photopolymer plate 102 from hanging.

Figure 6B:
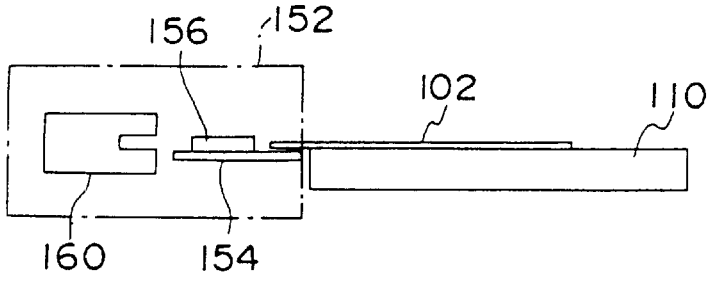
FIG. 6B is a side view of the surface plate.

As shown in FIG. 6B, a pressing plate 156 which forms a part of a conveying means for pressing the rear end portion of the photopolymer plate 102 in the conveying direction is provided at a part of the temporary support plate 154. When the rear end portion of the photopolymer plate 102 is pressed by the pressing plate 156, the curl of the photopolymer plate 102 is eliminated, and the photopolymer plate 102 can be sent to a predetermined standard position in the conveying direction. When the photopolymer plate 102 is at the standard position, the rear end portion thereof in the conveying direction slightly extrudes from the surface plate 110.

In the standard position, sensors 158 are provided at a plurality of positions including both corners of the rear end portion of the photopolymer plate 102 in the conveying direction. When the rear end portion of the photopolymer plate 102 in the conveying direction is detected by the sensors 158, the pressing plate 156 is stopped from pressing. Further, the sensors 158 are also applied for detecting the position of the photopolymer plate 102 in the transverse direction of conveyance. Specifically, the corners of the photopolymer plate 102 are adjusted so as to be in line with the sensors 158 by moving the surface plate 110 in the transverse direction of conveyance, and the detected position is registered as a start position of the photopolymer plate 102.

The position of the photopolymer plate 102 moved to the start position is determined relative to a starting position of scanning exposure at the exposure section 112. As described later in detail, the photopolymer plate 102 is sucked and held in this state by vertical suction grooves 320, radial suction grooves 322 and the like provided at the surface plate 110.

A punch is formed at the sucked and held photopolymer plate 102 by a puncher 160 provided on the moving body 152.

The surface plate 110 can move back and forth at an uniform velocity between a first position (see the position shown with solid lines in FIG. 1), at which the photopolymer plate 102 is received from the photopolymer plate conveying portion 130, and a second position (see the position shown with notched lines in FIG. 1), at which the photopolymer plate 102 is accommodated in the exposure section 112. (Movement in the transverse direction of the conveyance for positioning also takes place in this back and forth manner.)

At the exposure section 112, a scanning unit 164 is provided above the conveying path of the surface plate 110, and laser beams which are light-controlled in accordance with image signals are primarily scanned (in the direction orthogonal to the conveying direction of the surface plate 110). On the other hand, forward conveyance of the surface plate 110 is a movement for secondary scanning. As a result, an image is recorded onto the photopolymer plate 102 on the surface plate 110 during the forward conveyance to the exposure section 112, and then, the photopolymer plate 102 is returned to the original position by return conveyance. The photopolymer plate 102 on the surface plate 110, which has been returned to the original position, is released from the state of being sucked and held.

Figure 7A:
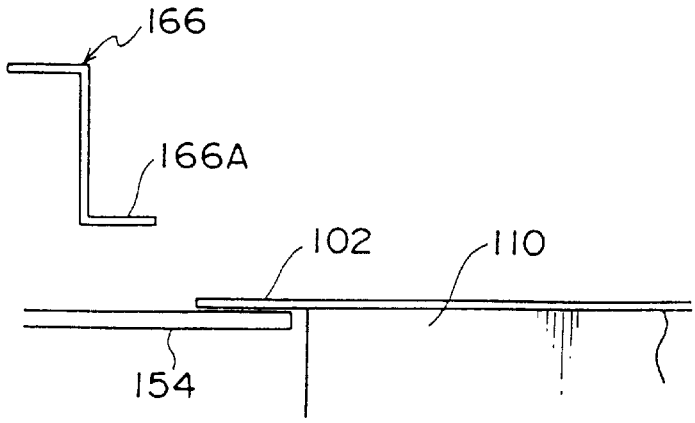
FIG. 7A is a side view showing an operation of a discharging mechanism portion at the beginning thereof.

When the image has been recorded on the photopolymer plate 102 and the surface plate 110 has been returned to the original position, a discharging mechanism portion 166, which was on standby at the rear end portion side of the photopolymer plate 102 in the direction that the plate is conveyed by the photopolymer plate conveying portion 130, passes over the surface plate 110 so as to move to a front end portion side of the photopolymer plate 102 in the conveying direction (see FIG. 7A).

Figure 7B:
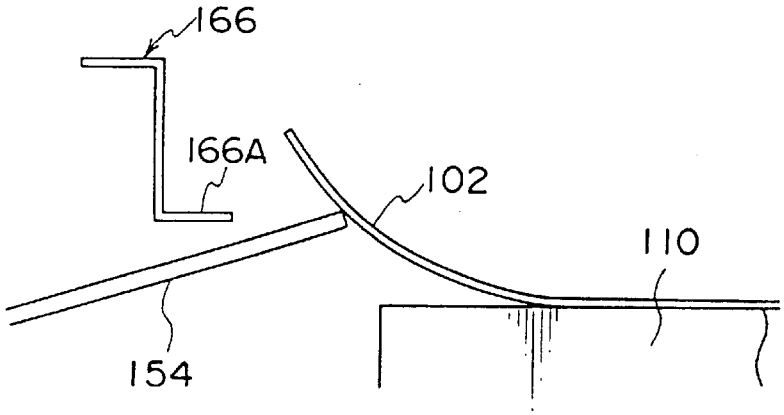
FIG. 7B is a side view showing an operation of the discharging mechanism portion in a state in which the photopolymer plate is lifted up.
Figure 7C:
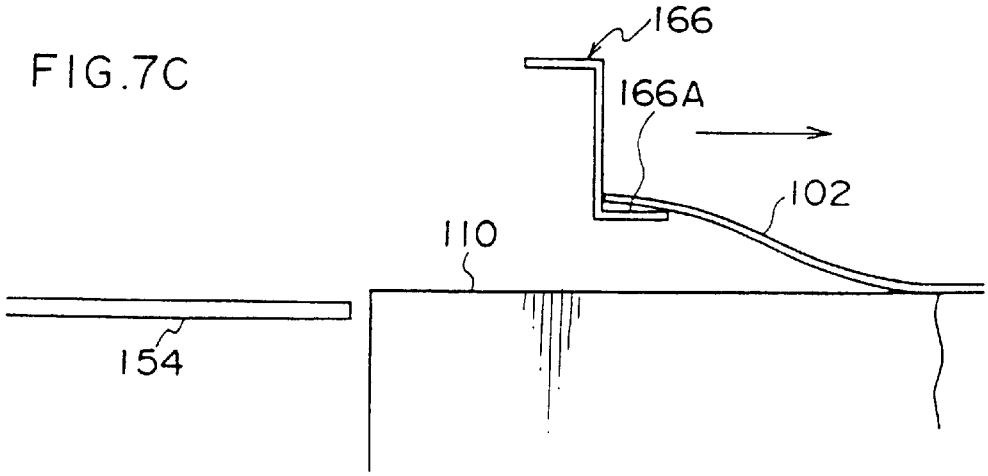
FIG. 7C is a side view showing an operation of the discharging mechanism portion at the time of the discharging.

Hook portions 166A for loading the rear end portion of the photopolymer plate 102 in the conveying direction are formed at the discharging mechanism portion 166. The rear end portion of the photopolymer plate 102 which extrudes from the surface plate 110 is lifted up by the temporary support plate 154 provided on the moving body 152 (see FIG. 7B), and the discharging mechanism portion 166 is moved in the direction that the photopolymer plate 102 is conveyed. As a result, the photopolymer plate 102 is engaged with the hook portions 166A, and while the discharging mechanism portion 166 is moved, the photopolymer plate 102 is conveyed to a downstream side of the surface plate 110 (see FIG. 7C). The buffer portion 114 and further the automatic developing apparatus 116 for printing plates, are provided at this downstream side. While the difference between a discharging speed at the discharging mechanism portion 166 and a conveying speed at the automatic developing apparatus 116 for printing plates is absorbed by the buffer portion 114, the photopolymer plate 102 is smoothly sent out.

Figure 8:
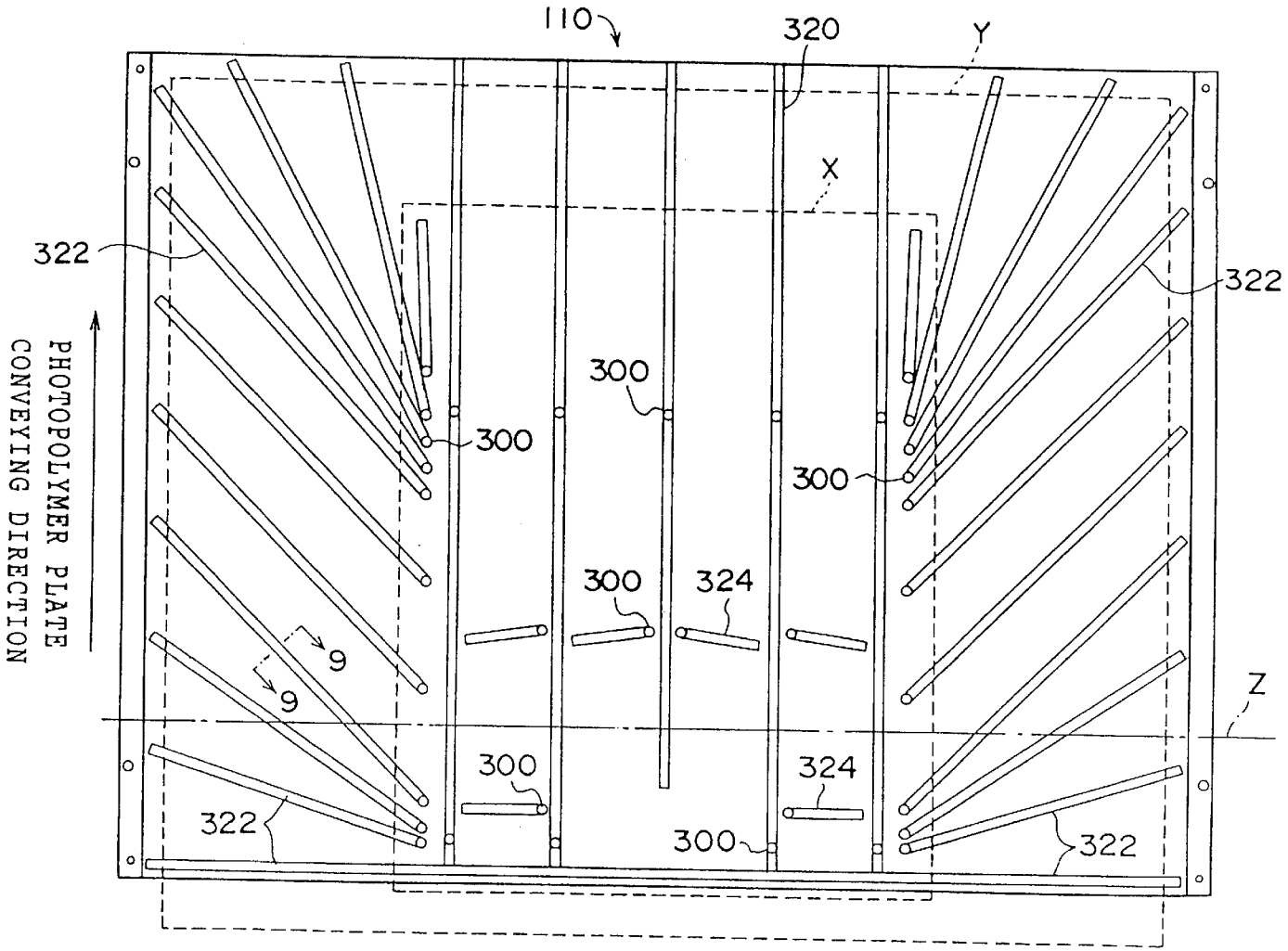
FIG. 8 is a plan view of the surface plate.

FIG. 8 shows the surface plate 110 in a detailed plan view.

A plurality of suction holes 300 are formed at the surface plate 110, and all of the suction holes 300 are disposed at a center portion side of the top surface of the surface plate 110 (specifically, within a range in which a photopolymer plate 102 of a minimum size is disposed when at the start position (i.e., the region X in FIG. 8)). Further, the suction holes 300 communicating with the vertical suction grooves 320, the radial suction grooves 322 and parallel suction grooves 324, which grooves will be described later, are disposed at the surface plate 110 top surface center portion side of the vertical suction grooves 320, the radial suction grooves 322 and the parallel suction grooves 324, respectively.

A plurality of vertical suction grooves 320 and radial suction grooves 322 which communicate with the suction holes 300 are formed on the top surface of the surface plate 110. The vertical suction grooves 320 are formed at the center portion of the surface plate 110 so as to be parallel to the conveying direction of the photopolymer plate 102, and the radial suction grooves 322 are radially formed outside of the vertical suction grooves 320. The vertical suction grooves 320 and the radial suction grooves 322 extend to an external peripheral portion of the top surface of the surface plate 110 (specifically, an external peripheral portion of a range in which a photopolymer plate 102 of a maximum size is disposed when at the start position (i.e., the region Y in FIG. 8)). Further, a plurality of parallel suction grooves 324 which communicate with the suction holes 300 are formed on the top surface of the surface plate 110. The parallel suction grooves 324 are formed at an upstream side of the photopolymer plate 102 conveying direction on the surface plate 110 so as to be substantially perpendicular to the vertical suction grooves 320. All of the suction holes 300 communicating with the radial suction grooves 322 are disposed within the region X in FIG. 8 and near a periphery thereof.

Figure 10:
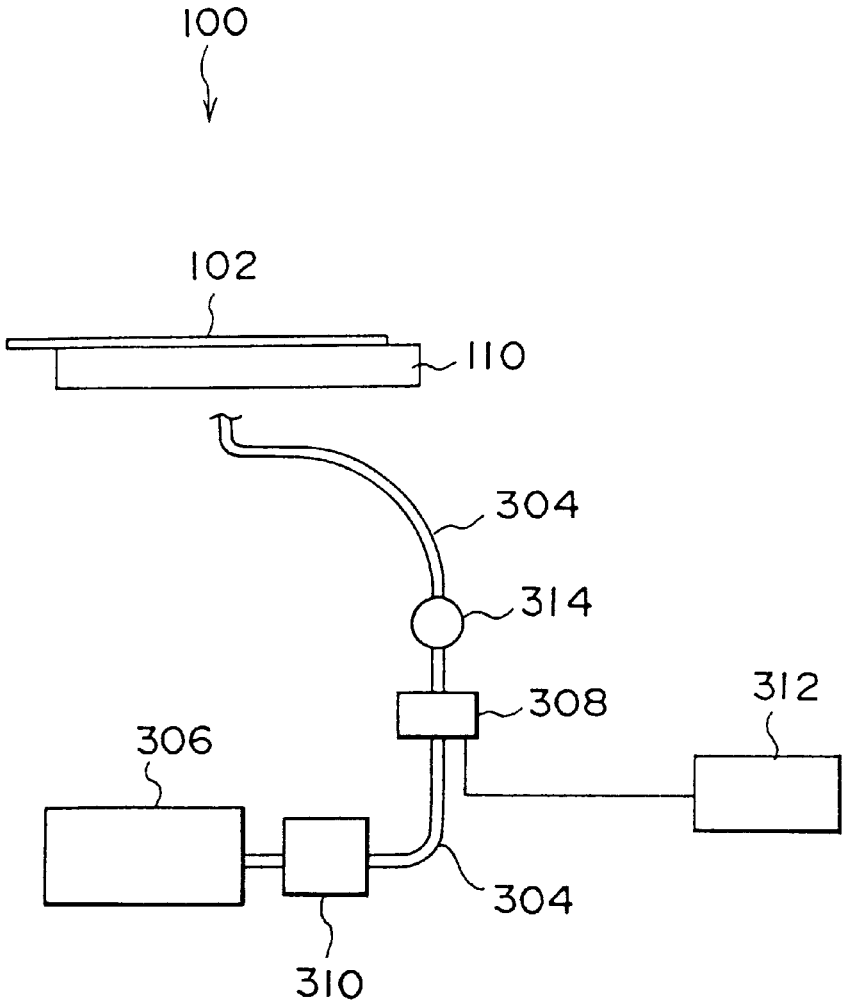

As shown in FIG. 10, all of the suction holes 300 communicate with the vacuum pump 306 via a communicating path 304. As for sucking ability of the vacuum pump 306 in the present embodiment, for example, a maximum amount of air displacement (i.e., a maximum volume of air exhausted per unit time) is 17.0 $m^3/h$ (in a case of operating at 50 Hz) or 20.5 $m^3/h$ (in a case of operating at 60 Hz), and an attainable vacuum (i.e., a degree of vacuum realizable with the vacuum pump) is 150 hPa (absolute vacuum). When the vacuum pump 306 sucks air from the suction holes 300 via the communicating path 304, the interior of the suction holes 300, the vertical suction grooves 320, the radial suction grooves 322 and the parallel suction grooves 324 is brought to a vacuum state. As a result, the photopolymer plate 102, which is disposed at the start position on the top surface of the surface plate 110 as described above, is vacuum-sucked onto the top surface of the surface plate 110 by the suction holes 300, the vertical suction grooves 320, the radial suction grooves 322 and the parallel suction grooves 324. Further, a filter 314 is provided at the communicating path 304.

A solenoid valve 308 is provided at the communicating path 304 between the suction holes 300 and the vacuum pump 306 (between the filter 314 and the vacuum pump 306), and the solenoid valve 308 can freely open and close the communicating path 304. When the solenoid valve 308 is opened, air can be sucked from the suction holes 300 by the vacuum pump 306.

A chamber 310 as a portion to be decompressed is provided at the communicating path 304 between the solenoid valve 308 and the vacuum pump 306, and the chamber 310 has a predetermined capacity and the interior thereof is decompressed. When the solenoid valve 308 is closed and the vacuum pump 306 is operated, air is sucked from the decompressed interior of the chamber 310 by the vacuum pump 306, and the decompressed interior is thereby further decompressed (i.e., a vacuum of the decompressed interior is increased).

The solenoid valve 308 is connected to a controller 312. If air is sucked from the decompressed interior of the chamber 310 by the vacuum pump 306 as described above, and the solenoid valve 308 is opened completely in an instant by the controller 312 in a state in which a pressure of the decompressed interior is a predetermined value or lower, the decompressed interior of the chamber 310 can suck air all at once from the suction holes 300.

The vertical suction grooves 320 and the radial suction grooves 322 are all disposed in the external peripheral portion of the surface plate 110 (external peripheral portion of the region Y in FIG. 8) so as to be spaced apart by 80 mm or less, and thus, the vertical suction grooves 320 and the radial suction grooves 322 can maintain a strong suction force with respect to the photopolymer plate 102 also in the external peripheral portion of the surface plate 110. The vertical suction grooves 320 and the radial suction grooves 322 are spaced apart by 80 mm or less at all portions.

Further, a surface roughness for the top surface of the surface plate 110 is in a range from 3.2 a to 6.3 a, and thus, the top surface of the surface plate 110 is slightly irregular. Therefore, the top surface of the surface plate 110 has slight spaces in portions excluding the suction holes 300, the vertical suction grooves 320, the radial suction grooves 322 and the parallel suction grooves 324. Accordingly, the top surface of the surface plate 110 can suction the photopolymer plate 102 even in the portions excluding the suction holes 300, the vertical suction grooves 320, the radial suction grooves 322 and the parallel suction grooves 324.

All of the vertical suction grooves 320, the radial suction grooves 322 and the parallel suction grooves 324, which are at a more downstream side in the photopolymer plate 102 conveying direction than a landing point (a position of broken line Z in FIG. 8) where a front end portion of the photopolymer plate 102 in the conveying direction conveyed by the photopolymer plate conveying portion 130 lands on the surface plate 110, are inclined with respect to a direction which is perpendicular to the conveying direction. Therefore, an angle of the photopolymer plate 102 conveying direction with respect to the vertical suction grooves 320, the radial suction grooves 322 and the parallel suction grooves 324 is reduced. As a result, even if the photopolymer plate 102 slides on the top surface of the surface plate 110 when the photopolymer plate 102 is conveyed onto the top surface of the surface plate 110, the front end portion of the photopolymer plate 102 in the conveying direction is prevented from being caught in the vertical suction grooves 320, the radial suction grooves 322 and the parallel suction grooves 324 in the state in which the photopolymer plate 102 is being conveyed.

Further, the vertical suction grooves 320 and the radial suction grooves 322, which are at a more downstream side in the photopolymer plate 102 conveying direction than the position of broken line Z in FIG. 8, are inclined at an angle of 30 degrees or more with respect to a direction which is perpendicular to the conveying direction. As a result, the front end portion of the photopolymer plate 102 in the conveying direction is reliably prevented from being caught in the vertical suction grooves 320 and the radial suction grooves 322 in the state in which the photopolymer plate 102 is being conveyed.

Figure 9:
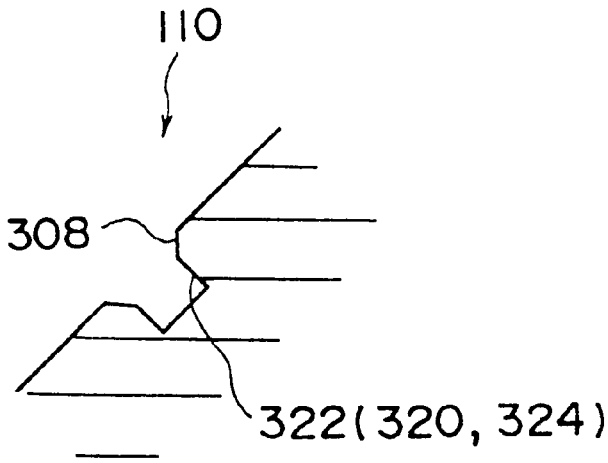
FIG. 9 is a cross-sectional view of the surface plate (cross-sectional view along line 9—9 in FIG. 8).

As shown in FIG. 9, all of top end corner portions at opening sides of the vertical suction grooves 320, the radial suction grooves 322 and the parallel suction grooves 324 are chamfered so as to form chamfered portions 308. Therefore, even if the photopolymer plate 102 slides on the top surface of the surface plate 110 when the photopolymer plate 102 is conveyed onto the top surface of the surface plate 110, an angle formed when the photopolymer plate 102 abuts the top end corner portions at the opening sides of the vertical suction grooves 320, the radial suction grooves 322 and the parallel suction grooves 324 is reduced. Thus, the photopolymer plate 102 can slide smoothly on the vertical suction grooves 320, the radial suction grooves 322 and the parallel suction grooves 324.

Further, the top surface of the surface plate 110 is subjected to a so-called lubricating process (for example, a TUFRAM (Registered ™) process or a DRILUBE (Registered ™) process). Therefore, even if the photopolymer plate 102 slides on the top surface of the surface plate 110 when the photopolymer plate 102 is conveyed onto the top surface of the surface plate 110, the photopolymer plate 102 can slide smoothly on the top surface of the surface plate 110.

Next, an operation of the present embodiment will be described.

In the automatic exposure apparatus 100 for printing plates, which has the above-described structure, when the photopolymer plate 102 is conveyed by the photopolymer plate conveying portion 130 and the pressing plate 156 so as to be disposed at the start position on the top surface of the surface plate 110, and the vacuum pump 306 sucks air from the suction holes 300 of the surface plate 110 via the communicating path 304, the interior of the suction holes 300, the vertical suction grooves 320, the radial suction grooves 322 and the parallel suction grooves 324 is brought to a vacuum state, and the photopolymer plate 102 disposed on the top surface of the surface plate 110 is vacuum-sucked onto the top surface of the surface plate 110 by the suction holes 300, the vertical suction grooves 320, the radial suction grooves 322 and the parallel suction grooves 324. Further, an image is recorded onto the photopolymer plate 102 sucked onto the top surface of the surface plate 110 by the exposure section 112, and thereafter, the photopolymer plate 102 is conveyed to the automatic developing apparatus 116 for printing plates.

By the way, a height of the top surface of the surface plate 110 is lower than a horizontal conveyance height of the photopolymer plate conveying portion 130, and there is a slight gap therebetween in the conveying direction. Accordingly, when the photopolymer plate 102 is discharged from the photopolymer plate conveying portion 130, a front end portion of the photopolymer plate 102 in the conveying direction lands on the surface plate 110 (at the position of broken line Z in FIG. 8) in a state in which it hangs slightly. Further, when a rear end portion of the photopolymer plate 102 in the conveying direction is pressed by the pressing plate 156, the photopolymer plate 102 is sent to a predetermined standard position. As a result, in the automatic exposure apparatus 100 for printing plates according to the present embodiment, when the photopolymer plate 102 is conveyed by the photopolymer plate conveying portion 130 and the pressing plate 156, the front end portion of the photopolymer plate 102 in the conveying direction slides on the top surface of the surface plate 1 10.

All of the vertical suction grooves 320, the radial suction grooves 322 and the parallel suction grooves 324, which are at a more downstream side in the photopolymer plate 102 conveying direction than a landing point (a position of broken line Z in FIG. 8) where a front end portion of the photopolymer plate 102 in the conveying direction conveyed by the photopolymer plate conveying portion 130 lands on the surface plate 110, are inclined with respect to a direction which is perpendicular to the conveying direction. Therefore, an angle of the photopolymer plate 102 conveying direction with respect to the vertical suction grooves 320, the radial suction grooves 322 and the parallel suction grooves 324 is reduced. As a result, even if the photopolymer plate 102 slides on the top surface of the surface plate 110 when the photopolymer plate 102 is conveyed onto the top surface of the surface plate 110, the front end portion of the photopolymer plate 102 in the conveying direction can be prevented from being caught in the vertical suction grooves 320, the radial suction grooves 322 and the parallel suction grooves 324 in the state in which the photopolymer plate 102 is being conveyed, and the formation of scratches, cracks, and creases on the photopolymer plate 102 can be thereby prevented.

Further, the vertical suction grooves 320 and the radial suction grooves 322, which are at a more downstream side in the photopolymer plate 102 conveying direction than the position of broken line Z in FIG. 8, are inclined at an angle of 30 degrees or more with respect to a direction which is perpendicular to the conveying direction. As a result, the front end portion of the photopolymer plate 102 in the conveying direction can be reliably prevented from being caught in the vertical suction grooves 320 and the radial suction grooves 322 in the state in which the photopolymer plate 102 is conveyed, and the photopolymer plate 102 can be thereby reliably prevented from being scratched, cracked, or creased.

As shown in FIG. 9, top end corner portions at opening sides of the vertical suction grooves 320, the radial suction grooves 322 and the parallel suction grooves 324 are provided with the chamfered portions 308. Therefore, even if the photopolymer plate 102 slides on the top surface of the surface plate 110 when the photopolymer plate 102 is conveyed onto the top surface of the surface plate 110, an angle formed when the photopolymer plate 102 abuts the top end corner portions at the opening sides of the vertical suction grooves 320, the radial suction grooves 322 and the parallel suction grooves 324 is reduced, and thus, the photopolymer plate 102 can slide smoothly on the vertical suction grooves 320, the radial suction grooves 322 and the parallel suction grooves 324. As a result, the front end portion of the photopolymer plate 102 in the conveying direction can be more reliably prevented from being caught in the vertical suction grooves 320, the radial suction grooves 322 and the parallel suction grooves 324 in the state in which the photopolymer plate 102 is being conveyed, and the photopolymer plate 102 can be thereby more reliably prevented from being scratched, cracked, or creased.

Further, the top surface of the surface plate 110 is subjected to a so-called lubricating process (for example, a TUFRAM (Registered ™) process or a DRILUBE (Registered ™) process). Therefore, even if the photopolymer plate 102 slides on the top surface of the surface plate 110 when the photopolymer plate 102 is conveyed onto the top surface of the surface plate 110, the photopolymer plate 102 can slide smoothly on the top surface of the surface plate 110. As a result, the front end portion of the photopolymer plate 102 in the conveying direction can be more reliably prevented from being caught in the vertical suction grooves 320, the radial suction grooves 322 and the parallel suction grooves 324 in the state in which the photopolymer plate 102 is being conveyed, and the photopolymer plate 102 can be thereby more reliably prevented from being scratched, cracked, or creased.

When the photopolymer plate 102 (hard printing plate) is singly stored, it may curl naturally. If this curled photopolymer plate 102 is disposed on the top surface of the surface plate 110, the photopolymer plate 102 is partially lifted from off the top surface of the surface plate 110.

In the automatic exposure apparatus 100 for printing plates according to the present embodiment, once the solenoid valve 308 is closed and the vacuum pump 306 is operated, air is sucked from the decompressed interior of the chamber 310 by the vacuum pump 306, and the decompressed interior is thereby further decompressed (i.e., a vacuum of the decompressed interior is increased). If the solenoid valve 308 is opened completely in an instant by the controller 312 in a state in which a pressure of the decompressed interior is a predetermined value or lower, the decompressed interior of the chamber 310 can suck the air all at once from the suction holes 300 with a strong suction force. Accordingly, even if sucking ability (a maximum amount of air displacement) of the vacuum pump 306 is low, when the solenoid valve 308 is opened completely in an instant by the controller 312, air can be sucked from the suction holes 300 with higher sucking ability than that of the vacuum pump 306, and thus, the curled photopolymer plate 102 can be set in complete contact with the top surface of the surface plate 110 (i.e., the photopolymer plate 102 can be in close contact with the top surface of the surface plate 110 without partially coming up off therefrom).

When the curled photopolymer plate 102 is in complete and close contact with the top surface of the surface plate 110, the suction holes 300, the vertical suction grooves 320, the radial suction grooves 322 and the parallel suction grooves 324 are closed by the photopolymer plate 102, and thus, a suction force due to the vacuum pump 306 easily reaches the photopolymer plate 102. Accordingly, even though sucking ability (a maximum amount of air displacement) of the vacuum pump 306 is low, if the vacuum pump 306 continuously sucks air from the suction holes 300 with this sucking ability, the photopolymer plate 102 does not partially come up from off the top surface of the surface plate 110. Therefore, once the curled photopolymer plate 102 is in complete and close contact with the top surface of the surface plate 110, by the vacuum pump 306 continuously sucking air from the suction holes 300, the photopolymer plate 102 can be kept in a state of completely being in contact with the top surface of the surface plate 110.

In this manner, in accordance with the automatic exposure apparatus 100 for printing plates, according to the present embodiment, the hard photopolymer plate 102 can be in complete contact with the top surface of the surface plate 110. Thus, when an image is recorded onto the photopolymer plate 102 by the exposure section 112, a defective image such as an unfocused image is prevented from being formed.

Next, a process of sucking and holding the photopolymer plate 102 onto the top surface of the surface plate 110 will be described.

Figure 11:
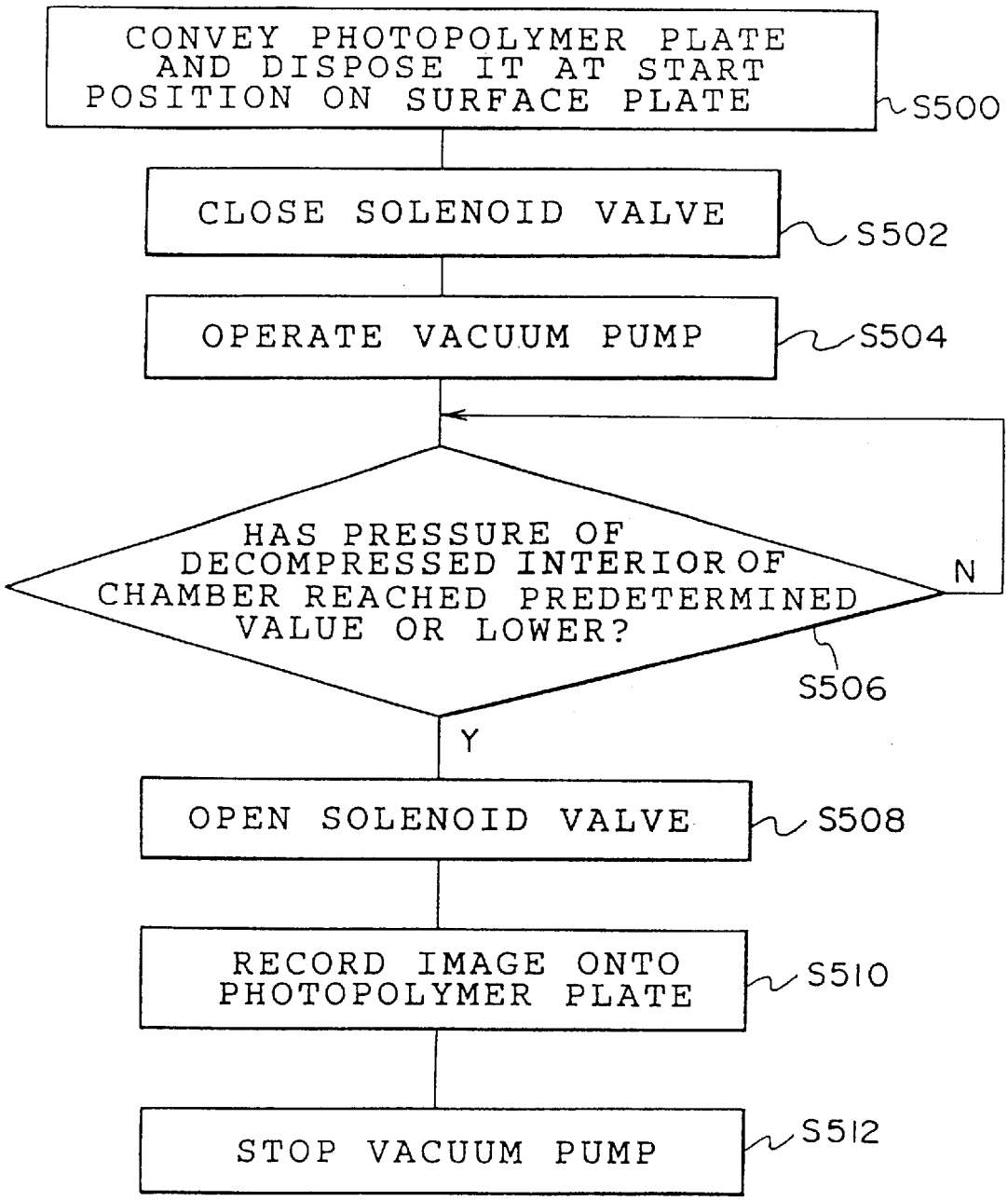
FIG. 11 is a flowchart showing a process of vacuum sucking the photopolymer plate onto a top surface of the surface plate.

FIG. 11 shows a flowchart of the process of sucking and holding the photopolymer plate 102 on the top surface of the surface plate 110.

In step 500, the photopolymer plate 102 is conveyed by the photopolymer plate conveying portion 130 and the pressing plate 156 so as to be disposed at the start position on the top surface of the surface plate 110. In step 502, the solenoid valve 308 is closed, and thereafter in step 504, the vacuum pump 306 is operated so as to suck air from the decompressed interior of the chamber 310, and the decompressed interior is thereby further decompressed (i.e., a vacuum of the decompressed interior is increased). In step 506, if a pressure of the decompressed interior of the chamber 310 has not reached a predetermined value or lower, air is further sucked from the decompressed interior by the vacuum pump 306 so that the pressure of the decompressed interior reaches the predetermined value or lower.

When the pressure of the decompressed interior of the chamber 310 has reached the predetermined value or lower in step 506, in step 508, the solenoid valve 308 is opened completely in an instant by the controller 312, and air is sucked all at once from the suction holes 300 by the decompressed interior of the chamber 310 with a strong suction force. Accordingly, even if the photopolymer plate 102 is curled, the photopolymer plate 102 can be in complete contact with the top surface of the surface plate 110. After that, in step 510, air is continuously sucked from the suction holes 300 by the vacuum pump 306 so as to maintain the state in which the photopolymer plate 102 is completely in contact with the top surface of the surface plate 110, and an image is recorded onto the photopolymer plate 102 in this state.

When the recording of the image onto the photopolymer plate 102 has been completed in step 510, in step 512, the vacuum pump 306 is stopped. As a result, the photopolymer plate 102 is released from the state of being sucked and held onto the top surface of the surface plate 110.

If a curled photopolymer plate 102 is disposed on the top surface of the surface plate 110, a center portion of the photopolymer plate 102 is in contact with the top surface of the surface plate 110, but the photopolymer plate 102 is raised up further from off the top surface of the surface plate 110 towards the outer peripheral portion of the photopolymer plate 102.

In a case in which the photopolymer plate 102 is of a maximum size, all of the suction holes 300 are disposed at a center portion side of the top surface of the surface plate 110 (the surface plate 110 center portion side of the radial suction grooves 322 and the parallel suction grooves 324, within the region X in FIG. 8), and the center portion of the curled photopolymer plate 102 is in contact with the top surface of the surface plate 110 as described above. Thus, when air is sucked from the suction holes 300 by the vacuum pump 306, the center portion of the photopolymer plate 102 can be brought in complete contact with the top surface of the surface plate 110 with a strong suction force due to the suction holes 300 disposed at the center portion side of the top surface of the surface plate 110, the vertical suction grooves 320, the radial suction grooves 322 and the parallel suction grooves 324. Further, when the center portion of the photopolymer plate 102 is completely in contact with the top surface of the surface plate 110 with a strong suction force, outer sides of the center portion of the photopolymer plate 102 approach the top surface of the surface plate 110, and thus, a suction force due to the vertical suction grooves 320 and the radial suction grooves 322 disposed at an external peripheral portion of the surface plate 110 easily reaches the outer sides of the center portion of the photopolymer plate 102, and the photopolymer plate 102 can be thereby brought into complete contact with the top surface of the surface plate 110 starting from the center portion and moving toward the external peripheral portion thereof. As a result, the photopolymer plate 102 of the maximum size can be set in more complete contact with the top surface of the surface plate 110 (i.e., the photopolymer plate 102 can be in close contact with the top surface of the surface plate 110 without partially coming up off therefrom). All of the suction holes 300 communicating with the radial suction grooves 322 are disposed within the region X in FIG. 8 and near a periphery thereof, and thus, distances between the suction holes 300 of the radial suction grooves 322 and side end portions thereof which are opposite to the suction holes 300 are short. Also as the result of this, a suction force due to the radial suction grooves 322 disposed at the external peripheral portion of the surface plate 110 is strong.

On the other hand, in a case in which the photopolymer plate 102 is of the minimum size, when air is sucked from the suction holes 300 by the vacuum pump 306, the center portion of the photopolymer plate 102 being in contact with the top surface of the surface plate 110 is brought in complete contact with the top surface of the surface plate 110 with a strong suction force due to the suction holes 300 disposed at the center portion of the top surface of the surface plate 110, the vertical suction grooves 320 and the parallel suction grooves 324. Further, when the center portion of the photopolymer plate 102 is completely in contact with the top surface of the surface plate 110 with a strong suction force, the external peripheral portion of the photopolymer plate 102 approaches the top surface of the surface plate 110, and thus, a suction force due to the vertical suction grooves 320 and the radial suction grooves 322 formed at the external peripheral portion of the region X in FIG. 8 easily reaches the external peripheral portion of the photopolymer plate 102, and the external peripheral portion of the photopolymer plate 102 is thereby also brought in complete contact with the top surface of the surface plate 110 with a strong suction force. As a result, the photopolymer plate 102 of the minimum size can be also set in more complete contact with the top surface of the surface plate 110 (i.e., the photopolymer plate 102 can be in close contact with the top surface of the surface plate 110 without partially coming up off therefrom).

In this manner, regardless of size, the hard photopolymer plate 102 can be in more complete contact with the top surface of the surface plate 110. Thus, when an image is recorded onto the photopolymer plate 102 by the exposure section 112, a defective image such as an unfocused image is further prevented from being formed.

The vertical suction grooves 320 and the radial suction grooves 322 are disposed in the external peripheral portion of the surface plate 110 (the external peripheral portion of the range in which the photopolymer plate 102 of the maximum size is disposed, i.e., the external peripheral portion of the region Y in FIG. 8) so as to be spaced apart by 80 mm or less, and thus, the vertical suction grooves 320 and the radial suction grooves 322 have a strong suction force in the external peripheral portion of the surface plate 110. Further, the vertical suction grooves 320 and the radial suction grooves 322, which are on the surface plate 110 and in the external peripheral portion of the range in which the photopolymer plate 102 of the minimum size is disposed (i.e., the external peripheral portion of the region X in FIG. 8), are also disposed so as to be spaced apart by 80 mm or less. Thus, the vertical suction grooves 320 and the radial suction grooves 322 have a strong suction force in the external peripheral portion of the region X in FIG. 8. Therefore, regardless of the size of the photopolymer plate 102, the external peripheral portion of the photopolymer plate 102 can be reliably set in complete contact with the top surface of the surface plate 110, and the photopolymer plate 102 can be reliably set in complete contact with the top surface of the surface plate 110. Thus, when an image is recorded onto the photopolymer plate 102 by the exposure section 112, a defective image such as an unfocused image is reliably prevented from being formed.

Further, a surface roughness for the top surface of the surface plate 110 is in a range from 3.2 a to 6.3 a, and thus, the top surface of the surface plate 110 is slightly irregular. Therefore, the top surface of the surface plate 110 has slight spaces in portions excluding the suction holes 300, the vertical suction grooves 320, the radial suction grooves 322 and the parallel suction grooves 324. Accordingly, when air is sucked from the suction holes 300 by the vacuum pump 306, the top surface of the surface plate 110 has a suction force also in the portions excluding the suction holes 300, the vertical suction grooves 320, the radial suction grooves 322 and the parallel suction grooves 324, and thus, the photopolymer plate 102 can be more reliably brought in complete contact with the top surface of the surface plate 110. Thus, when an image is recorded onto the photopolymer plate 102 by the exposure section 112, a defective image such as an unfocused image is more reliably prevented from being formed.

In the present embodiment, the solenoid valve 308 is completely opened in an instant by the controller 312 in a state in which a pressure of the decompressed interior of the chamber (decompressed portion) 310 is a predetermined value or lower. However, the solenoid valve (open-close valve) may be completely opened in an instant by the controller (controlling means) at the time when air has been sucked from the decompressed interior of the chamber (decompressed portion) by the vacuum pump (sucking means) for a predetermined time.

Further, in the above embodiment, the vertical suction grooves 320 and the radial suction grooves 322 are disposed in the external peripheral portion of the surface plate 110 so as to be spaced apart by 80 mm or less. However, the vertical suction grooves 320 and the radial suction grooves 322 may be disposed in the external peripheral portion of the surface plate 110 so as to be spaced apart by 100 mm or less.

Furthermore, in the above embodiment, a surface roughness for the top surface of the surface plate 110 is in a range from 3.2 a to 6.3 a. However, the surface roughness for the top surface of the surface plate 110 may be 1.6 a or higher.

Figure 12:
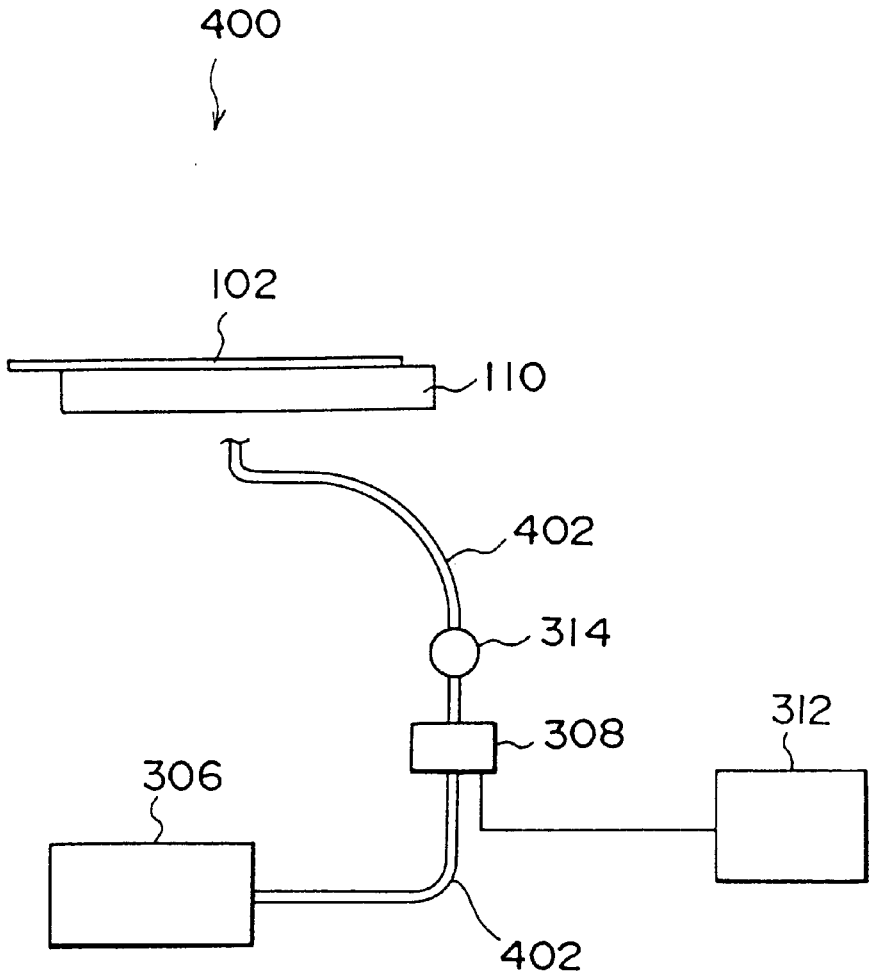
FIG. 12 is a schematic structural view showing the surface plate, the solenoid valve, the chamber, the vacuum pump and the like in an automatic exposure apparatus for printing plates according to a modified example of the present embodiment.

As in an automatic exposure apparatus 400 for printing plates shown in FIG. 12, even if the chamber is not provided at a communicating path 402, the curled photopolymer plate (printing plate) 102 can be brought in complete contact with the top surface of the surface plate 110 by using the capacity of the decompressed interior of the communicating path 402 between the solenoid valve 308 and the vacuum pump 306. Further, a capacity of the decompressed interior of the communicating path 304 can be increased without the need for the chamber 310 to be provided at the communicating path 304, by increasing a diameter of the decompressed interior of the communicating path 304 between the solenoid valve 308 and the vacuum pump 306, or by increasing a length of the communicating path (decompressed interior) 304 between the solenoid valve 308 and the vacuum pump 306.

Figure 13:
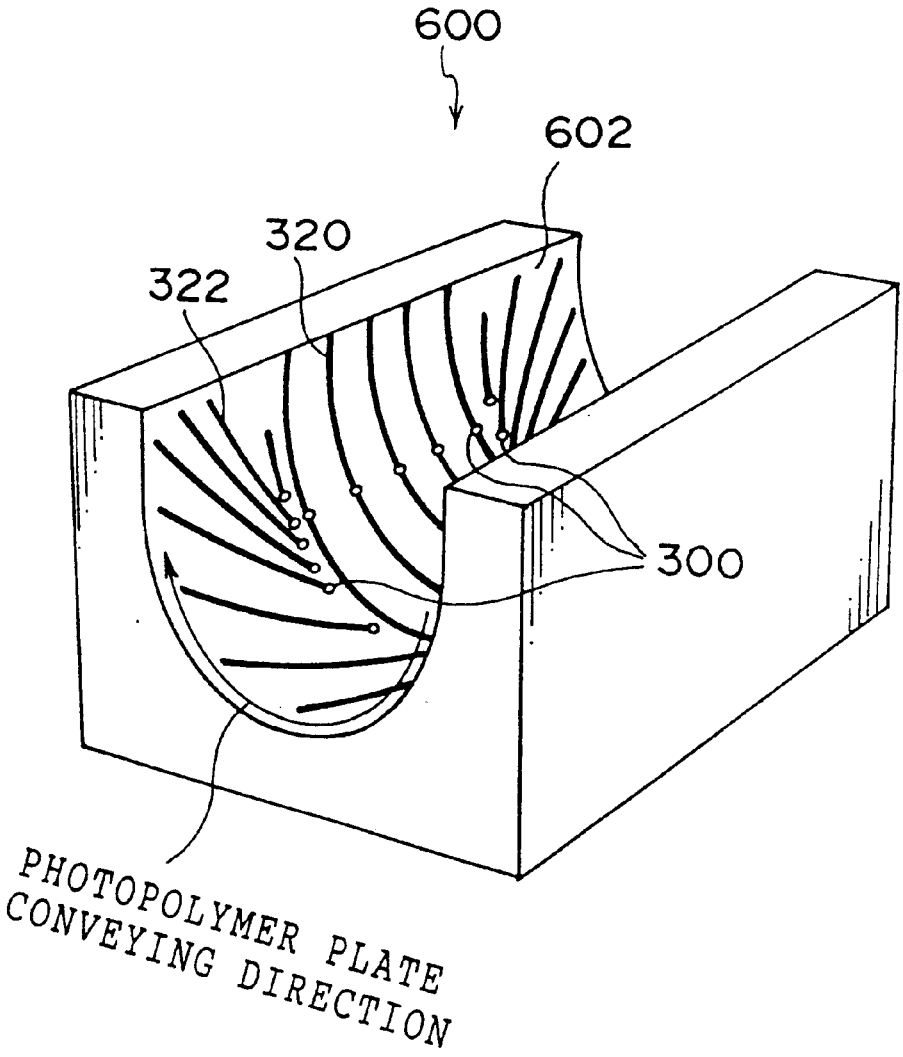
FIG. 13 is a perspective view showing an inner drum.

As shown in FIG. 13, a so-called inner drum 600 can be used as an exposing table. In this case, the inner drum 600 is formed so that a cross section thereof is in a substantially U shape, and a loading surface 602 is provided at an interior of the inner drum 600 (a top surface of the U-shaped cross sectional portion). The loading surface 602 is the top surface of the surface plate 110 in the above embodiment which is curved so that a cross section thereof is in a U shape, and the same suction holes 300, vertical suction grooves 320, radial suction grooves 322 and parallel suction grooves 324 as those in the above embodiment are provided at the loading surface 602.

Figure 14:
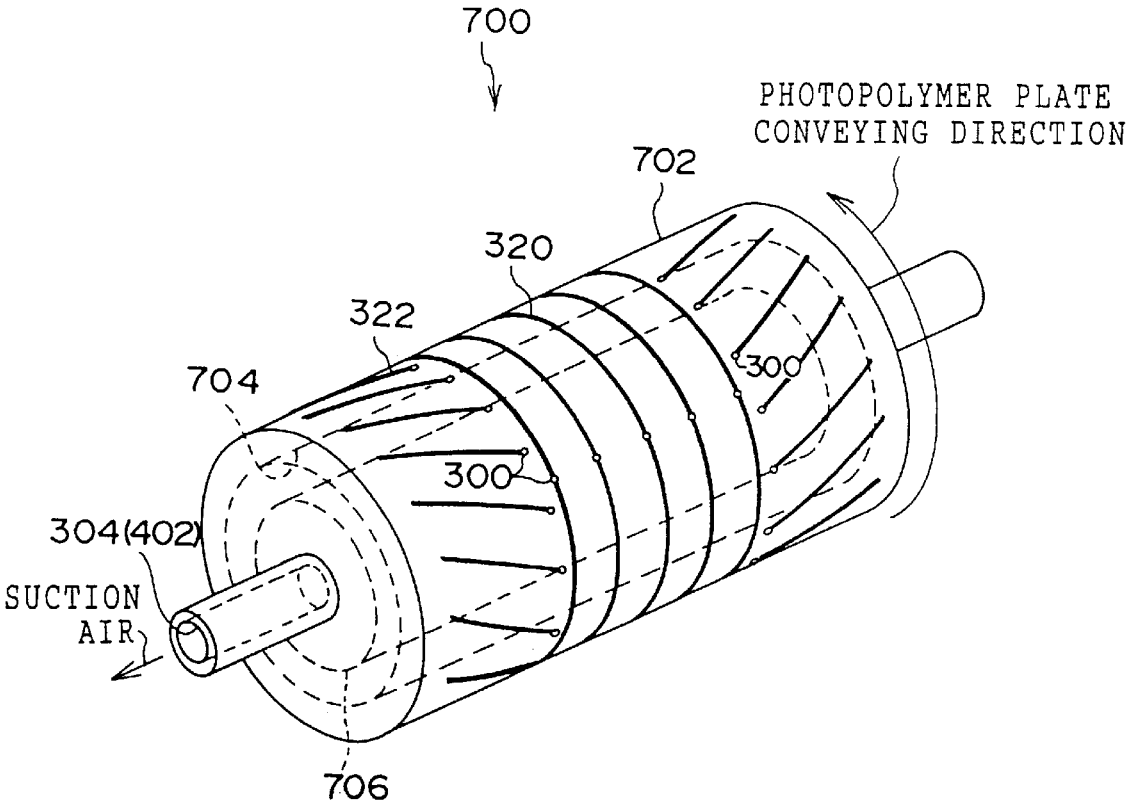
FIG. 14 is a perspective view showing an outer drum.

As shown in FIG. 14, a so-called outer drum 700 can be used as an exposing table.

In this case, the outer drum 700 is formed in a substantially cylindrical shape, a loading surface 702 is provided at a peripheral surface of the outer drum 700. The loading surface 702 is the top surface of the surface plate 110 in the above embodiment which is curved so that a cross section thereof is in a circular shape, and the same suction holes 300, vertical suction grooves 320, radial suction grooves 322 and parallel suction grooves 324 as those in the above embodiment are provided at the loading surface 702. An interior of the outer drum 700 is hollow so as to form a hollow portion 704, and the hollow portion 704 communicates with the suction holes 300. The same communicating path 304 (or communicating path 402) as those in the above embodiment is provided at a side wall of the outer drum 700, and the communicating path 304 communicates with the hollow portion 704. The communicating path 304 communicates with the vacuum pump (sucking means) 306 via the solenoid valve (open-close valve) 308 and the like in the same manner as in the above embodiment. When air is sucked by the vacuum pump 306, the interior of the suction holes 300, the vertical suction grooves 320, the radial suction grooves 322 and the parallel suction grooves 324 is brought to a vacuum state via the communicating path 304, the hollow portion 704 and the like, and the photopolymer plate (printing plate) 102 is vacuum-sucked onto the loading surface 702.

An insertion 706 is disposed inside the hollow portion 704, and the capacity of the hollow portion 704 is reduced by the insertion 706. As a result, an amount of air sucked by the vacuum pump 306 can be reduced.

As described above, in accordance with the automatic exposure apparatus for printing plates of the present invention, the open-close valve is closed and the sucking means is operated, and the open-close valve is completely opened in an instant by the controlling means in a state in which a pressure of the decompressed interior of the decompressed portion is a predetermined value or lower, such that the decompressed interior can suck air all at once from the suction holes with a strong suction force. Accordingly, the curled printing plate can be in complete contact with the loading surface. Further, once the curled printing plate is in complete contact with the loading surface, by continuously sucking air from the suction holes by the sucking means, the printing plate can be kept in the state of completely being in contact with the loading surface. Therefore, when an image is recorded onto the printing plate, a defective image such as an unfocused image is prevented from being formed.

When the center portion of the printing plate is completely in contact with the loading surface with a strong suction force due to the suction holes which are disposed at the loading surface center portion side of the suction grooves, outer sides of the center portion of the printing plate approach the loading surface, and thus, the outer sides of the center portion of the printing plate can be also brought in complete contact with the loading surface. As a result, the printing plate can be set in more complete contact with the loading surface. Therefore, when an image is recorded onto the printing plate, a defective image such as an unfocused image is further prevented from being formed.

The suction grooves, which are disposed at a more downstream side in the conveying direction than a landing point where a front end portion of the printing plate in the conveying direction conveyed by the conveying means lands on the loading surface, are inclined with respect to a direction which is perpendicular to the conveying direction, and thus, the front end portion of the printing plate in the conveying direction is prevented from being caught in the suction grooves of the loading surface in the state in which the printing plate is conveyed. Therefore, the printing plate can be prevented from being scratched, cracked, or creased.

In accordance with the exposing method of the present invention, the communicating path between the suction holes and the decompressed interior is closed and the sucking means is operated, and the communicating path between the suction holes and the decompressed interior is opened completely in an instant in a state in which a pressure of the decompressed interior is a predetermined value or lower, such that the decompressed interior can suck air all at once from the suction holes with a strong suction force. Accordingly, the curled printing plate can be brought into complete contact with the loading surface. Further, once the curled printing plate is brought into complete contact with the loading surface, by continuously sucking air from the suction holes by the sucking means, the printing plate can be kept in the state of completely being in contact with the loading surface. Therefore, when an image is recorded onto the printing plate, a defective image such as an unfocused image is prevented from being formed.

What is claimed is:

1. A sucking device for sucking a flexible thin plate on a top surface of a base, said device comprising:

a suction path with at least one aperture on the top surface of the base;

a suction unit operable to suck air from the apertures via said suction path;

a suction line in communication with said suction path and said suction unit;

a valve device provided on said suction line, and operable to open and close said suction line;

a hollow body provided on said suction line between said valve device and said suction unit, said hollow body having an internal pressure that can be decreased by an operation of said suction unit; and a controller operable to open said valve device, either when the internal pressure of said hollow body has reached a predetermined value or lower, or in accordance with a duration of operation of said suction unit.

2. A sucking device according to claim 1, wherein said top surface of the base includes a flat surface, onto which said flexible thin plate can be sucked.

3. A sucking device according to claim 1, wherein said apertures are disposed within an area of said top surface of the base, onto which said flexible thin plate can be sucked.

4. A sucking device according to claim 1, wherein each of said apertures communicates with a corresponding elongated suction channel, which is formed on said top surface of the base.

5. A sucking device according to claim 1, wherein said suction unit includes a vacuum pump.

6. A sucking device according to claim 1, wherein said valve device includes a solenoid valve.

7. A sucking device according to claim 1, wherein said hollow body is formed by a chamber as a decompressed portion.

8. A sucking device according to claim 1, wherein said hollow body is formed by a pipe, said pipe being longer than said suction line.

9. A sucking device according to claim 1, wherein said hollow body is formed by a pipe, said pipe having a diameter larger than a diameter of said suction line.

10. A sucking device according to claim 1, which further comprises:

a conveying portion, which supplies said flexible thin plate to said base; and a discharging mechanism portion, which discharges said flexible thin plate from said base.

11. A method of sucking a flexible thin plate onto a top surface of a base of a sucking device, said method comprising:

providing a suction path with at least one aperture on the top surface of the base;

providing a suction unit operable to suck air from the apertures via said suction path;

providing a suction line in communication with said suction path and said suction unit;

providing a valve device provided on said suction line, and operable to open and close said suction line;

providing a hollow body on said suction line between said valve device and said suction unit, said hollow body having an internal pressure that can be decreased by an operation of said suction unit;

decreasing the internal pressure of said hollow body; and opening said suction line via said valve device, wherein said suction line is opened in accordance with a duration of operation of the suction unit.

12. A method according to claim 11, wherein said suction line is opened when the internal pressure of said hollow body has reached a predetermined value or lower.

13. A method according to claim 12, further comprising closing said suction line prior to said decreasing the internal pressure of said hollow body.

14. A method according to claim 11, further comprising closing said suction line prior to said decreasing the internal pressure of said hollow body.

15. An exposure apparatus which includes a sucking device for sucking a printing plate onto a top surface of an exposing base, and which records an image onto the printing plate; said apparatus comprising:

a suction path with at least one aperture on the top surface of the base;

a suction unit operable to suck air from the apertures via said suction path;

a suction line in communication with said suction path and said suction unit;

a valve device provided on said suction line, and operable to open and close said suction line;

a hollow body provided on said suction line between said valve device and said suction unit, said hollow body having an internal pressure that can be decreased by an operation of said suction unit; and a controller operable to open said valve device in accordance with a duration of operation of said suction unit.

* * * * *